US006757978B1

(12) United States Patent
Huang

(10) Patent No.: US 6,757,978 B1
(45) Date of Patent: Jul. 6, 2004

(54) SCISSORS FOR ANGULARLY CUTTING SHEET STOCK

(76) Inventor: De Lun Huang, 11, Alley 2, Lane 673, Tu Cheng Rd., Ta-Le City, Taichung Hsien (TW)

( * ) Notice: Subject to any disclaimer, the term of this patent is extended or adjusted under 35 U.S.C. 154(b) by 0 days.

(21) Appl. No.: 10/409,274

(22) Filed: Apr. 7, 2003

(51) Int. Cl.[7] ..... B26B 17/00

(52) U.S. Cl. ..... 30/178; 30/179; 30/229; 30/233; 30/286; 30/293

(58) Field of Search ..... 30/173–179, 182, 30/186, 191, 194, 199, 201, 244, 261, 286, 335, 337, 339, 344, 233, 289, 293, 229, 231, 131, 123, 262

(56) References Cited

U.S. PATENT DOCUMENTS 2,709,298 A * 5/1955 Mater ..... 30/117
4,106,195 A * 8/1978 Berg ..... 30/293
5,542,182 A * 8/1996 Martinez ..... 30/179
5,673,487 A * 10/1997 Malagnoux ..... 30/179
5,913,575 A * 6/1999 Lai ..... 30/229
6,308,421 B1 * 10/2001 Wang ..... 30/178
6,532,847 B2 * 3/2003 Liou ..... 81/416
6,640,441 B1 * 11/2003 Huang ..... 30/233

* cited by examiner

*Primary Examiner*—Kenneth E. Peterson
*Assistant Examiner*—Omar Flores Sánchez
(74) *Attorney, Agent, or Firm*—Pro-Techtor International Services

(57) ABSTRACT

Scissors for angularly cutting sheet stock is disclosed. The scissors comprises oblique slots in a lower handle, fasteners in the oblique slots, a rear elongate slot in a lower ridge of a board, and a pin slidably defined in the elongate slot. In a closed state, fasteners are slid to a lowest point in the oblique slot to be urged by the ridge so that the ridge is prevented from further rearward movement with energy stored in a resilient piece. In a cutting operation press the lower and the upper handles against each other for causing the board and the blade to close on the sheet stock. The ridge pivots in response to pivoting the lower handle. Pin slides along the elongate slot to move the ridge. A rear portion of the board moves upward. A pointed end of the blade closes on a forward end of the board.

1 Claim, 6 Drawing Sheets

SCISSORS FOR ANGULARLY CUTTING SHEET STOCK

FIELD OF THE INVENTION

The present invention relates to scissors and more particularly to a pair of scissors for angularly cutting a sheet stock (e.g., plastic steel, plastics, wood, etc.) with improved characteristics.

BACKGROUND OF THE INVENTION

A pair of conventional scissors for angularly cutting a sheet stock (e.g., plastic steel, plastics, wood, etc.) is shown in FIG. 6. The scissors comprises a lower handle unit 11 having a U-shaped section, the lower handle unit 11 comprising aligned apertures 111 in the forward, aligned, elongated slots 112 behind the apertures 111, a block 113 disposed in the slots 112, aligned small apertures 114 below the slots 112, an elongate member 116, and a rivet 115 inserted through a rearward hole of the elongate member 116 and the apertures 114 for causing the elongate member 116 to be pivotal about the rivet 115 by manipulating a forward knob 117 of the elongate member 116; a blade 12 comprising a forward cutting edge 121, a rearward notch 123, the block 113 being disposed laterally across the slots 112 and the notch 123, an intermediate aperture 122, and a pin 124 inserted through the apertures 111 and 122; an upper handle unit 13 having a U-shaped section, the upper handle unit 13 comprising a forwardly projecting, channel-shaped arm 131, aligned apertures 132 in the forward, two openings 133 in the rear, a bolt 14 driven through the aligned openings 133, the apertures 122 and a washer 141 to be fastened by a cap nut 141, and a bottom recess 134 at the rear end of the arm 13, the recess 134 being adapted to lock the elongate member 116; an elongate, resilient piece 15 having a hole 151 in the rear fastened to the upper handle unit 13 by a rivet, the resilient piece 15 having a forward end disposed in the lower handle unit 11; a board 16 of sector-shaped comprising a lower ridge 161 disposed in the channel of the arm 131, a number of apertures 162 through the ridge 161 in which one of the apertures 162 is aligned with the apertures 132, a bolt 163 driven through washers 164, the apertures 132, and the aperture 162 to be fastened by a cap nut 165, a central slit 166, a cut 167 at the rearward end of the slit 166, the cut 167 being urged against arcuate top sides of the arm 131, and a plurality of equally spaced lines 168 originated from about the cut 167. In operation, place a sheet member formed of plastic steel, plastics, or wood on the board 16. Next, position the sheet member on the board 16 by aligning one side of the sheet member with one of the lines 168. Next, close the blade 12 on the sheet member by working the lower and upper handle units 11 and 13 against each other. Finally, the sheet member is angularly cut.

However, the prior art suffered from several disadvantages. For example, the sheet member tends to slip forward in the cutting process. This condition is particularly significant when the sheet member is relatively thick. In a case that the sheet member is formed of wood fiber the cut portion of the sheet member may squeeze toward the forward, uncut portion thereof. Hence, more force is required to cut the sheet member completely. Also, an uneven surface is formed on the cut portion of the sheet member, resulting in detraction from the sheet member's external appearance. Hence, a need for improvement exists.

SUMMARY OF THE INVENTION

It is therefore an object of the present invention to provide a pair of scissors for angularly cutting a sheet stock comprising an upper handle unit of U-shaped, the upper handle unit comprising a forwardly projecting, channel-shaped arm, forward apertures, and intermediate apertures; a lower handle unit of U-shaped, the lower handle unit comprising a channel-shaped forward arm having forward apertures, rivet apertures in a rear of the forward apertures thereof, first apertures below the rivet apertures, and oblique slots in a rear of the first and the rivet apertures; a blade comprising a cutting edge, a first aperture, and a rearward rivet aperture; a board of sector-shaped comprising a flat top, a lower ridge having a rear projected end, an elongate slot in a rear of the ridge, and an aperture in a forward of the ridge; a pair of fasteners each having an enlarged head and a shank; and an elongate, resilient piece disposed in the upper handle unit; wherein in assembly the forward apertures of the upper handle unit is aligned with the aperture of the board after placing the ridge in the arm of the upper handle unit with the flat top supported on the arm of the upper handle unit, insert first pins through the forward apertures of the upper handle unit and the aperture of the board to cause the board to pivotal about the upper handle unit, the elongate slot is aligned with the first apertures of the lower handle unit prior to inserting a second pin through the first apertures of the lower handle unit and the elongate slot with the head of the second pin urged against the first aperture of the lower handle unit, insert a rivet through the rivet apertures of the lower handle unit and the rivet aperture of the blade for fastening, the first aperture of the blade is aligned with the forward apertures and intermediate apertures of the upper handle unit after placing the arm of the lower handle unit in the arm of the upper handle unit and placing the blade in the arm of the lower handle unit sequentially, pivotably fasten the lower and the upper handle units and the blade together by inserting third pins through the forward apertures of the lower handle unit, the intermediate apertures of the upper handle unit, and the first aperture of the blade, the shanks of the fasteners are inserted into the oblique slot to be defined therein, and the heads of the fasteners are slidably urged against the oblique slot; for closing the scissors hold the lower and the upper handle units to apply force toward each other, the lower and the upper handle units are operative to close each other by pivoting about the third pins, the board and the cutting edge close on the sheet stock to be cut on the flat top by pivoting about the first pins in response to pivoting the upper handle unit, the flat top and the blade close on each other by pivoting about the first pins in response to pivoting the lower handle unit, a rear end of the elongate slot contacts the second pin as the fasteners have slid to a lowest point in the oblique slot to be urged by the ridge so that the ridge is prevented from further rearward movement with energy stored in the resilient piece; for opening the scissors push the fasteners to a highest point in the oblique slot prior to loosening a grip on the lower and the upper handle units, the stored energy of the resilient piece is applied on the blade to expand the lower and the upper handle units away from each other, the cutting edge and the flat top pivot about the first and the third pins respectively to open an opening therebetween, a forward end of the elongate slot contacts the second pin, and form a gap between a forward end of the blade and that of the flat top; and in a cutting operation press the lower and the upper handle units against each other for causing the board and the blade to close on the sheet stock, the ridge pivots in response to pivoting the lower handle unit, the second pin slides along the elongate slot to move the ridge, a rear portion of the flat top moves upward, and a pointed end of the blade closes on a forward end of the flat top. By utilizing this, the sheet stock can be smoothly, evenly cut by the blade.

The above and other objects, features and advantages of the present invention will become apparent from the following detailed description taken with the accompanying drawings.

DETAILED DESCRIPTION OF THE PREFERRED EMBODIMENTS

Figure 1:
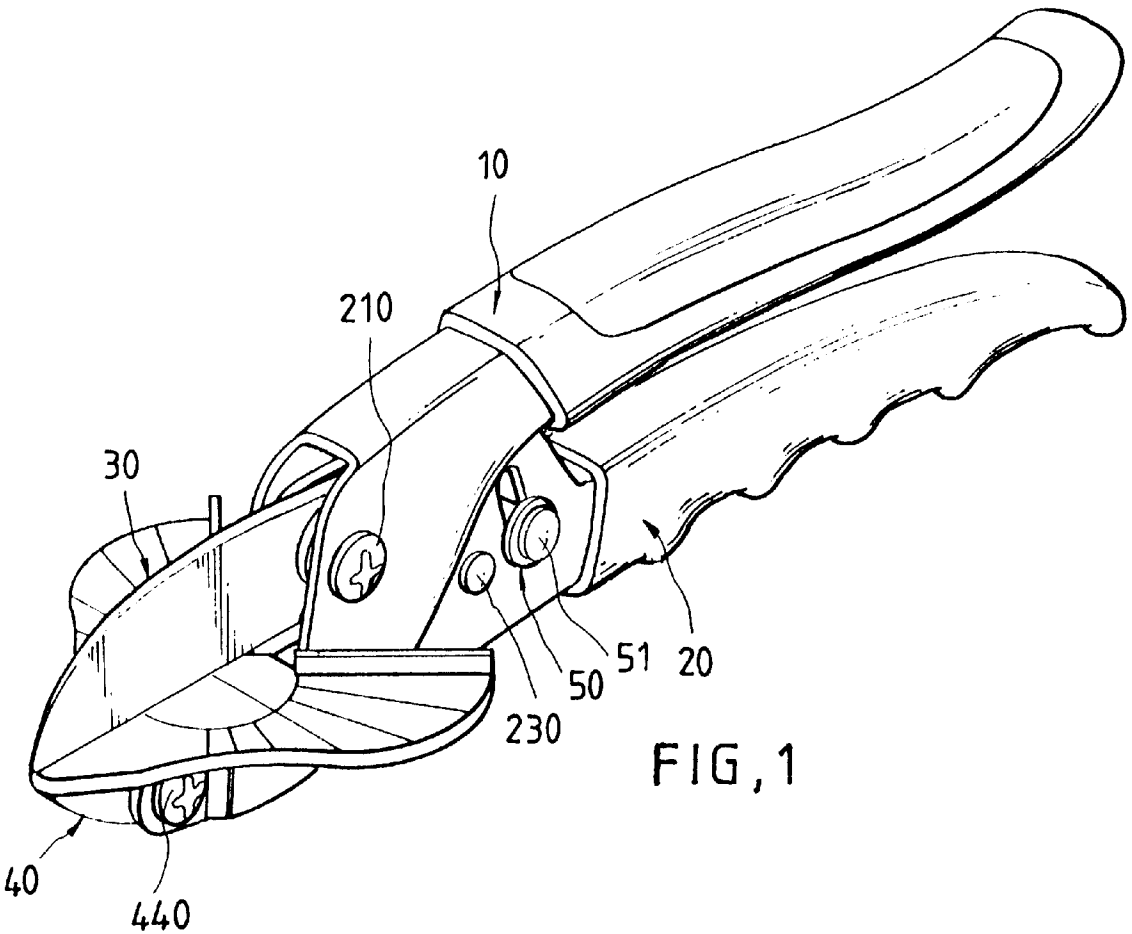
FIG. 1 is a perspective view of a preferred embodiment of a pair of scissors according to the invention.
Figure 2:
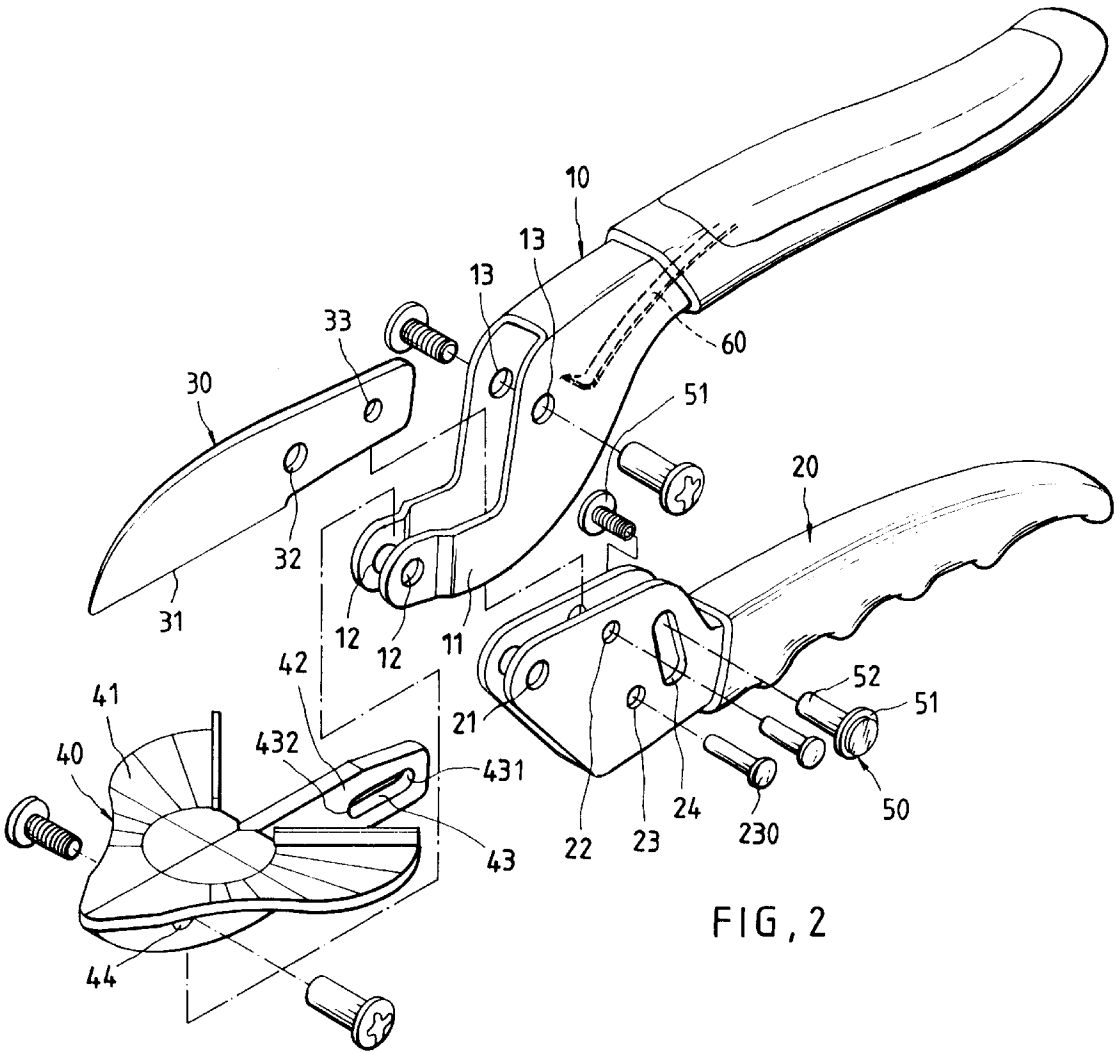
FIG. 2 is an exploded view of the scissors.

Referring to FIGS. 1 and 2, there is shown a pair of scissors for angularly cutting a sheet stock (e.g., plastic steel, plastics, wood, etc.) in accordance with the invention. The scissor comprises an upper handle unit 10 having a U-shaped section, the upper handle unit 10 comprising a forwardly projecting, channel-shaped arm 11, forward apertures 12, and intermediate apertures 13; a lower handle unit 20 having a U-shaped section, the lower handle unit 20 comprising a channel-shaped forward arm having forward apertures 21, rivet apertures 22 in the rear of the apertures 21, apertures 23 below the apertures 22, and oblique slots 24 in the rear of the apertures 21 and 23; a blade 30 comprising a forward cutting edge 31, an intermediate aperture 32, and a rearward rivet aperture 33; a board 40 of sector-shaped comprising a flat top 41, a lower ridge 42 having a rear projected end, an elongate slot 43 in the rear of the ridge 42, and an aperture 44 in the forward of the ridge 42; pins 50 each having an enlarged head 51 and a shank 52; and an elongate, resilient piece 60 disposed in the housing of the upper handle unit 10.

An assembly of the invention will now be described in detail below. First, align the apertures 12 with the aperture 44 after placing the ridge 42 in the channel of the arm 11 with the flat top 41 supported on the arm 11. Pins 440 are inserted through the apertures 12 and the aperture 44 to form a pivot of the board 40 about the upper handle unit 10. Also, the slot 43 is aligned with the apertures 23 prior to inserting a pin 230 through the apertures 23 and the slot 43 with the head of the pin 230 urged against the aperture 23. Insert a rivet through the apertures 22 and the rivet aperture 33 for fastening. Align the aperture 32 with the apertures 21 and 13 after placing the channel-shaped forward arm of the lower handle unit 20 in the channel of the upper handle unit 10 and placing the blade 30 in the channel of the lower handle unit 20 sequentially. Next, pivotably fasten the lower handle unit 20, the upper handle unit 10, and the blade 30 together by inserting pins 210 through the apertures 21, 13, and 32. The shanks 51 of the pins 50 are then inserted into the oblique slot 24 to be defined therein. The heads 51 of the pins 50 are slidably urged against the oblique slot 24.

Figure 3:
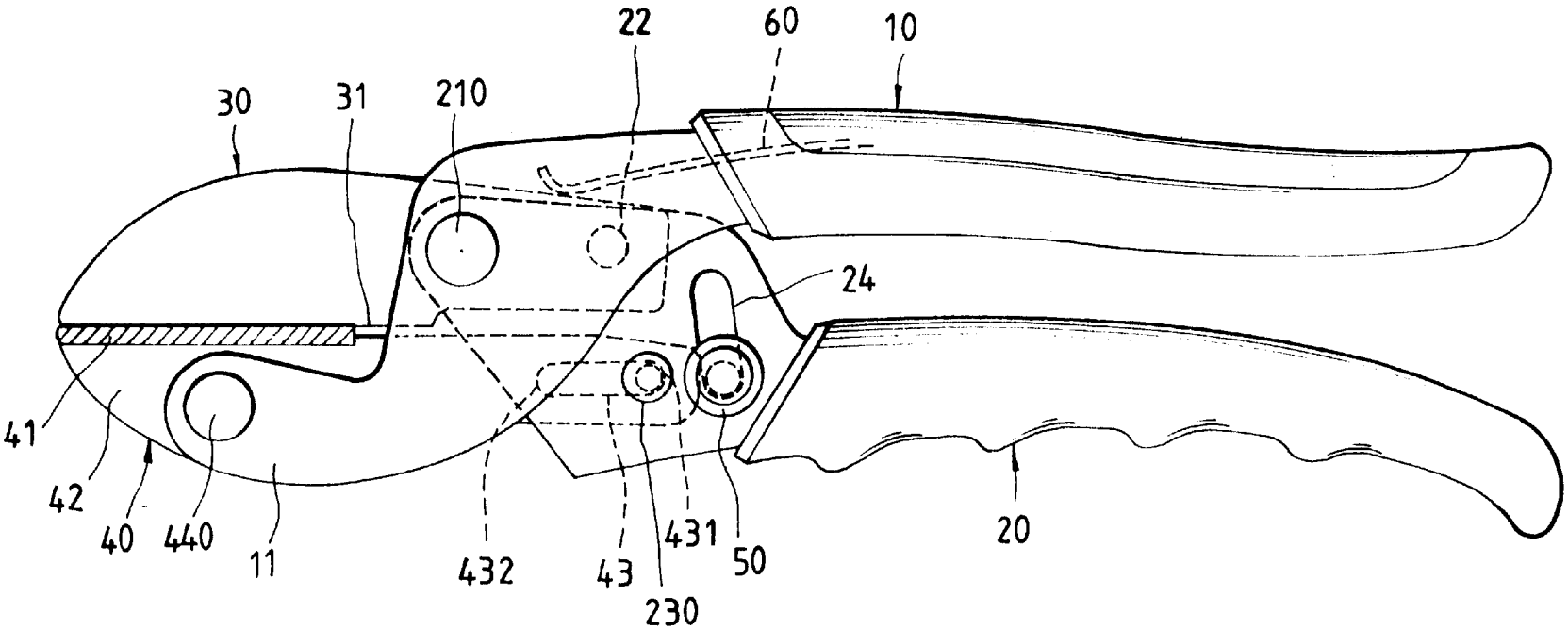
FIG. 3 is a side plan view of the scissors in a closed state.
Figure 4:
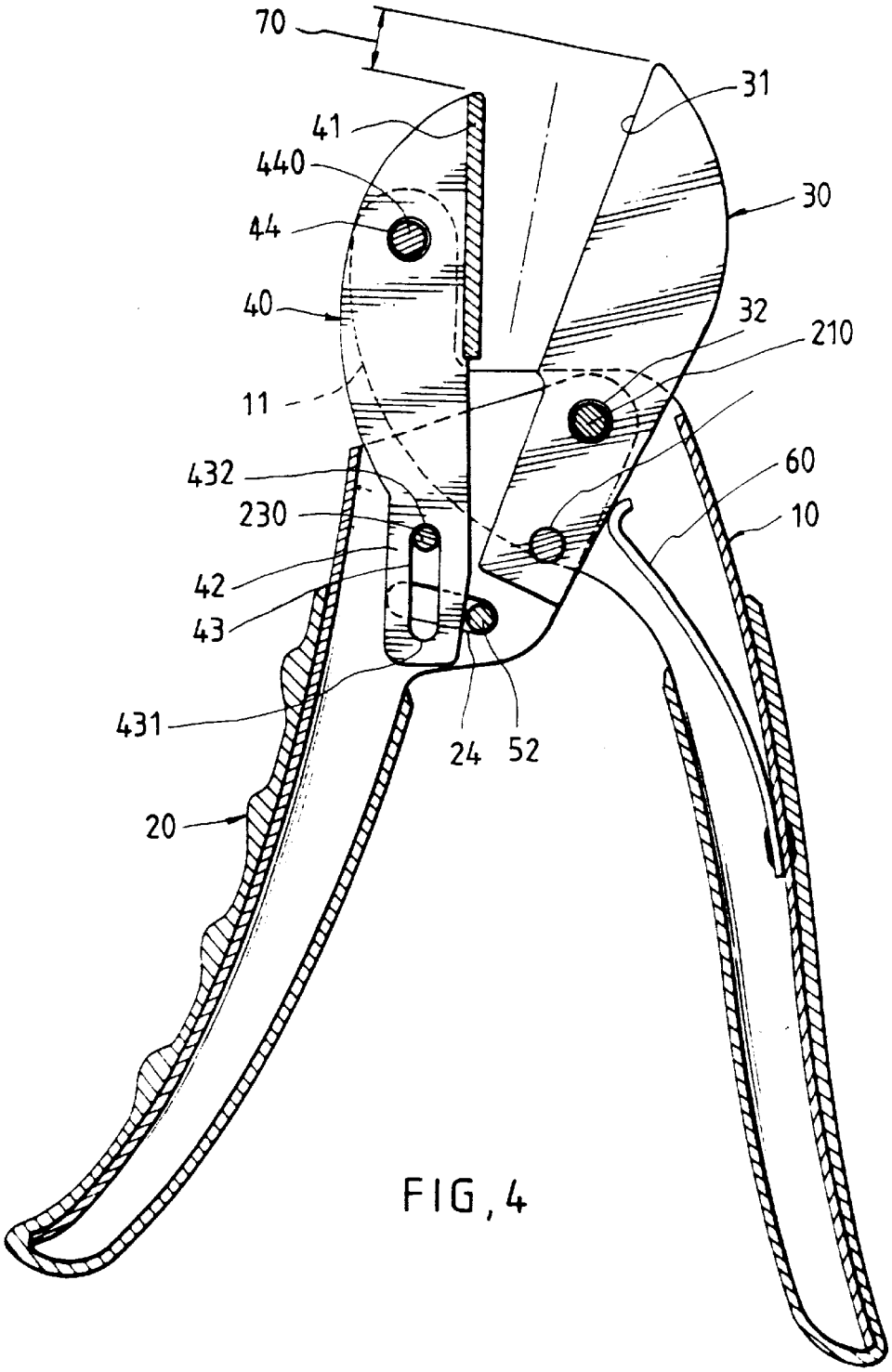
FIG. 4 is a side plan view in part section of the scissors in an open state.

Referring to FIGS. 3 and 4, closed and open states of the scissors will now be described in detail below. A user can hold the lower and upper handle units 20 and 10 to apply force toward each other. As a result, the lower and the upper handle units 20 and 10 close each other by pivoting about the pins 210. At the same time, the board 40 and the cutting edge 31 of the blade 30 close on a sheet stock (not shown) to be cut on the flat top 41 by pivoting about the pins 440 in response to the pivoting of the upper handle unit 10. Also, the flat top 41 and the blade 30 close on each other by pivoting about the pins 440 in response to the pivoting of the lower handle unit 20. A rear end 431 of the slot 43 is in contact with the pin 230 as the pins 50 have slid to a lowest point in the oblique slot 24 to be urged by the ridge 42 so that the ridge 42 is prevented from further rearward movement (see FIG. 3). Note that energy is stored in the resilient piece 60 in the closed state of the scissors. To the contrary, the user can push the pin 50 to a highest point in the oblique slot 24 prior to loosening a grip on the lower and the upper handle units 20 and 10. Next, the stored energy of the resilient piece 60 is applied on the blade 30 to expand the lower and the upper handle units 20 and 10 away from each other. Accordingly, the cutting edge 31 and the flat top 41 pivot about the pins 210 and 440 respectively to open an opening therebetween. At this time, a forward end 432 of the slot 43 is in contact with the pin 230. Further, a gap 70 is formed between a forward end of the blade 30 and that of the flat top 41. The formed gap 70 is a result of the provision of the slot 43 in the ridge 42. The gap 70 can further increase the opening between the cutting edge 31 and the flat top 41. As such, the sheet stock can be placed further into a joint of the blade 30 and the flat top 41. As an end, a labor saving cutting process can be carried out.

Figure 5:
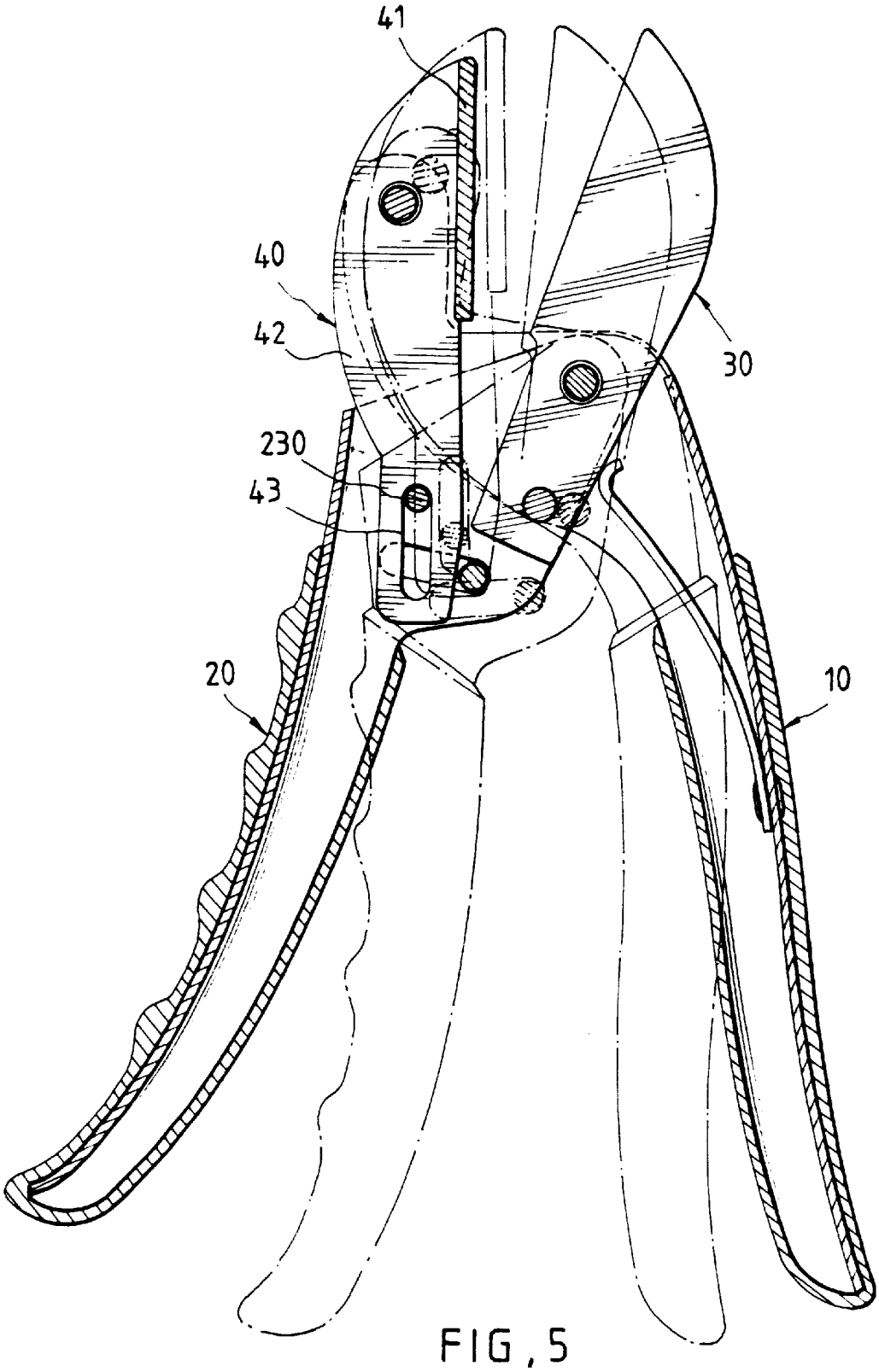
FIG. 5 is a view similar to FIG. 4 where the scissors is operating.
Figure 6:
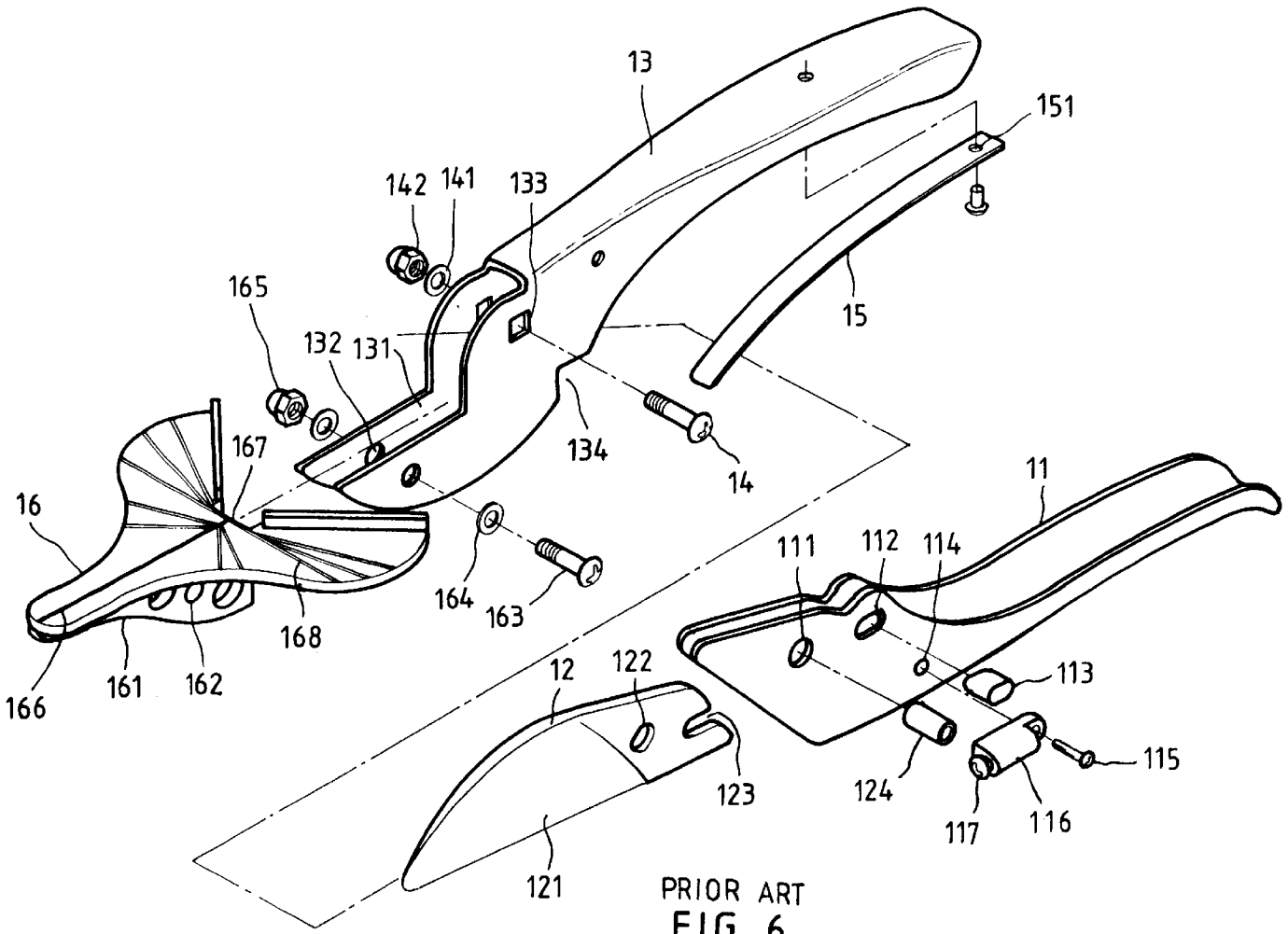
PRIOR ART FIG. 6
FIG. 6 is a perspective view of a pair of conventional scissors for angularly cutting sheet stock.

Referring to FIG. 5, a cutting operation of the invention will now be described in detail below. First, press the lower and the upper handle units 20 and 10 against each other for causing the board 40 and the blade 30 to close on the sheet stock. The ridge 42 pivots in response to the pivoting of the lower handle unit 20. As such, the pin 230 slides along the slot 43 to move the ridge 42. Accordingly, the rear portion of the flat top 41 moves upward and the pointed end of the blade 30 closes on the forward end of the flat top 41. Hence, the blade 30 is able to smoothly, evenly cut the sheet stock.

While the invention has been described by means of specific embodiments, numerous modifications and variations could be made thereto by those skilled in the art without departing from the scope and spirit of the invention set forth in the claims.

What is claimed is:

1. A pair of scissors for angularly cutting a sheet stock comprising:

an upper handle unit of U-shape, the upper handle unit comprising a forwardly projecting, channel-shaped arm, forward apertures, and intermediate apertures;

a lower handle unit of U-shape, the lower handle unit comprising a channel-shaped forward arm having forward apertures, rivet apertures to the rear of the forward apertures first apertures below the rivet apertures, and oblique slots to the rear of the first and the rivet apertures;

a blade comprising a cutting edge, a first aperture, and a rearward rivet aperture;

a board of sector-shape comprising a flat top, a lower ridge having a rear projected end, an elongate slot to the rear of the ridge, and an aperture in a forward of the ridge;

a pair of fasteners each having an enlarged head and a shank; and an elongate, resilient piece disposed in the upper handle unit;

wherein the forward apertures of the upper handle unit are aligned with the aperture of the board after placing the ridge in the arm of the upper handle unit with the flat top supported on the arm of the upper handle unit, the first pins are inserted through the forward apertures of the upper handle unit and the aperture of the board to cause the board to pivot about the upper handle unit, a second pin is through the first apertures of the lower handle unit and the elongate slot with the head of the second pin urged against on of the first apertures of the lower handle unit, a rivet is inserted through the rivet apertures of the lower handle unit and the rivet aperture of the blade for fastening, the first aperture of the blade is aligned with the intermediate apertures of the upper handle unit, after placing the arm of the lower handle unit in the arm of the upper handle unit and placing the blade in the arm of the lower handle unit are inserted third pins through the forward apertures of the lower handle unit, the intermediate apertures of the up per handle unit, and the first aperture of the blade, the shanks of the pair of fasteners are inserted into the oblique slot, and the heads of the pair of fasteners are slidably urged against the oblique slot; the lower and upper handle units are operative to close toward each other by pivoting about the third pins, the board and the cutting edge close on the sheet stock to be cut on top by pivoting about the first pins in response to pivoting the upper handle unit, the flat and the lower handle unit, a rear end of the elongate slot contacts the second pin as the pair of fasteners have slid to a lowest point in the oblique slot so that the ridge is prevented from further rearward movement with energy stored in the resilient piece; the stored energy of the resilient piece is applied on the blade to expand the lower and the upper handle units away from each other, and the cutting edge and the flat top pivot about the first and the third pins respectively to open an opening therebetween, a forward end of the elongate slot contacts the second pin, and thus forms a gap between a forward end of the blade and that of the flat top; wherein a cutting operation presses lower and the upper handle units against each other for causing the board and the blade to close on the sheet stock, the ridge pivots in response to pivoting the lower handle unit, the second pin slides along the elongate slot to move the ridge, a rear portion of the flat top moves upward, and a pointed end of the blade closes on a forward end of the flat top.

* * * * *